US007125159B2

(12) United States Patent
Hirsch et al.

(10) Patent No.: US 7,125,159 B2
(45) Date of Patent: Oct. 24, 2006

(54) NON-DEFEATABLE FLUORESCENT ADAPTER FOR INCANDESCENT FIXTURE

(75) Inventors: Michael E. Hirsch, Cherry Hill, NJ (US); Douglas R. Bray, Medford Lakes, NJ (US)

(73) Assignee: Sea Gull Lighting Products, Inc., Riverside, NJ (US)

( * ) Notice: Subject to any disclaimer, the term of this patent is extended or adjusted under 35 U.S.C. 154(b) by 134 days.

(21) Appl. No.: 10/828,870

(22) Filed: Apr. 20, 2004

(65) Prior Publication Data

US 2005/0231951 A1 Oct. 20, 2005

(51) Int. Cl.
*H01R 33/00* (2006.01)

(52) U.S. Cl. ..... 362/651; 362/222; 362/260; 362/649

(58) Field of Classification Search ..... 362/216, 362/221, 222, 260, 649, 650; 439/236, 240, 439/314

See application file for complete search history.

(56) References Cited

U.S. PATENT DOCUMENTS

| | | | | | |
|---|---|---|---|---|---|
| 2,422,222 | A | | 6/1947 | Carroll | 173/344 |
| 3,467,937 | A | * | 9/1969 | Norton | 338/219 |
| 3,551,736 | A | | 12/1970 | Doehner | 315/100 |
| 4,495,443 | A | | 1/1985 | Cummings | 315/58 |
| 4,503,358 | A | | 3/1985 | Kamei et al. | 315/58 |
| 4,570,105 | A | | 2/1986 | Engel | 315/58 |
| 4,623,823 | A | * | 11/1986 | Engel | 315/58 |
| 4,624,513 | A | * | 11/1986 | Haraden | 439/1 |
| 4,683,402 | A | | 7/1987 | Aubrey | 315/56 |
| 4,688,874 | A | | 8/1987 | Bjorkman | 439/56 |
| 4,723,200 | A | | 2/1988 | Troen | 362/260 |
| 4,745,323 | A | | 5/1988 | Northrop et al. | 313/25 |
| 4,750,892 | A | * | 6/1988 | Santopietro | 439/307 |
| 4,841,193 | A | | 6/1989 | Nakamura et al. | 313/318 |
| 4,936,789 | A | * | 6/1990 | Ugalde | 439/236 |
| 4,939,420 | A | | 7/1990 | Lim | 315/58 |
| 5,015,917 | A | | 5/1991 | Nigg | 315/56 |
| 5,065,292 | A | | 11/1991 | Aubrey | 362/260 |
| 5,128,590 | A | | 7/1992 | Holzer | 315/58 |
| 5,286,216 | A | * | 2/1994 | Volz | 439/236 |
| 5,304,076 | A | | 4/1994 | Pelton et al. | 439/683 |
| 5,320,548 | A | | 6/1994 | Schadhauser | 439/236 |

(Continued)

FOREIGN PATENT DOCUMENTS

| | | |
|---|---|---|
| JP | 59-121757 A | 7/1984 |

OTHER PUBLICATIONS

Harmony Lighting-Super Spira lamps Brochures (data unknown).

*Primary Examiner*—Thomas M. Sember
*Assistant Examiner*—Adam C. Rehm
(74) *Attorney, Agent, or Firm*—Drinker Biddle & Reath LLP

(57) ABSTRACT

A fluorescent adapter having a housing including a tip contact compatible with an electrical socket, a threaded ring contact compatible with the electrical socket, the ring contact surrounding the housing and rotatable with the housing when the housing is rotated in a first direction and not rotatable with the housing when the housing is rotated in an opposite direction, and a fluorescent ballast supported by the housing and having input electrodes in electrical contact with the tip contact and the ring contact, respectively, and output electrodes for removably receiving the contact pins of a fluorescent lamp. The adapter is easily inserted into the socket but is not removable after insertion.

11 Claims, 5 Drawing Sheets

U.S. PATENT DOCUMENTS

| | | | | |
|---|---|---|---|---|
| 5,422,487 | A | 6/1995 | Sauska et al. | 250/436 |
| 5,428,515 | A | 6/1995 | Jung | 362/226 |
| 5,585,688 | A | 12/1996 | DeKleine | 313/318.01 |
| 5,634,820 | A | 6/1997 | Vakil | 439/646 |
| 5,653,527 | A | 8/1997 | Muessli | 362/226 |
| 5,675,215 | A | 10/1997 | Watson et al. | 313/493 |
| 5,703,440 | A | 12/1997 | Kachmarik et al. | 315/56 |
| 5,705,883 | A | 1/1998 | Soules et al. | 313/318.09 |
| 5,864,461 | A | 1/1999 | Cho | 361/674 |
| 5,971,564 | A | 10/1999 | Wang | 362/263 |
| 6,011,347 | A | 1/2000 | Wittmann | 313/318.09 |
| 6,059,593 | A | 5/2000 | Pasternak | 439/236 |
| 6,494,730 | B1 | 12/2002 | Yan | 439/226 |
| 6,525,455 | B1 | 2/2003 | Matsuba et al. | 313/318.04 |
| 6,582,253 | B1 | 6/2003 | Lau | 439/646 |
| 6,582,269 | B1 | 6/2003 | Sakai et al. | 445/26 |
| 6,736,526 | B1 * | 5/2004 | Matsuba et al. | 362/260 |
| 6,759,797 | B1 | 7/2004 | Tokes et al. | 313/318.01 |

* cited by examiner

FIG.4
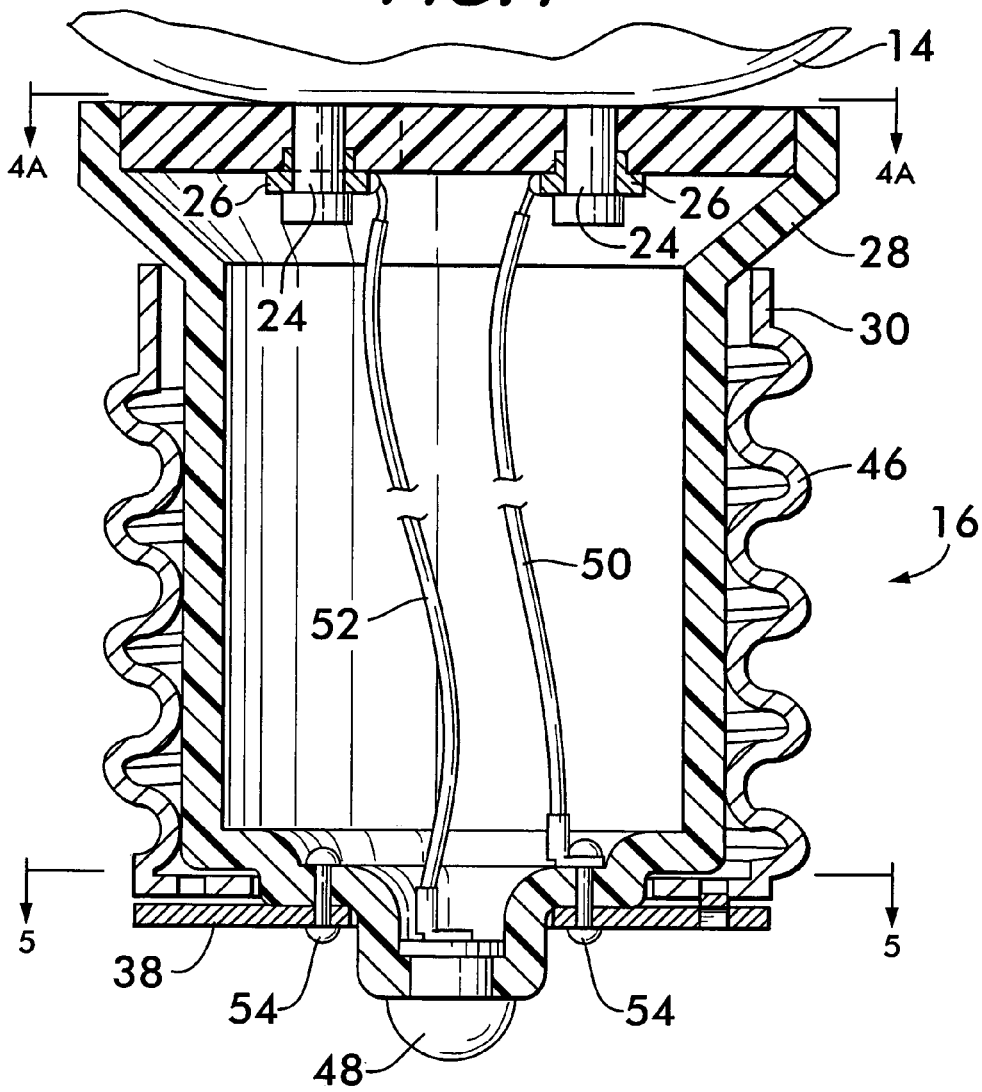
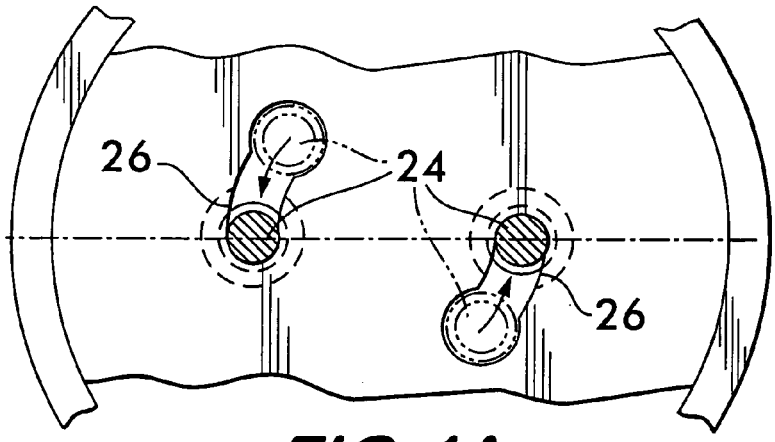
FIG.4A

FIG.5
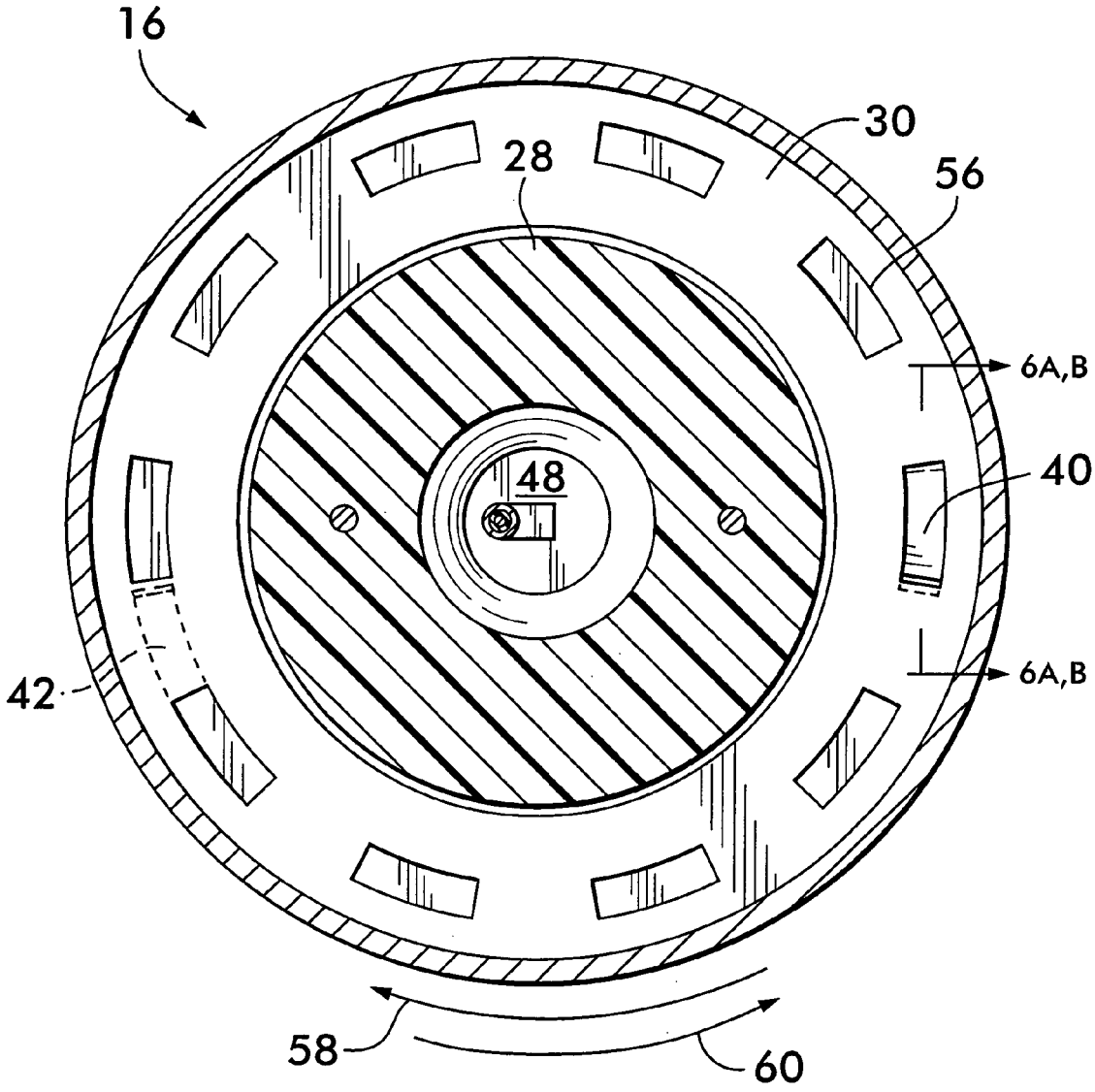
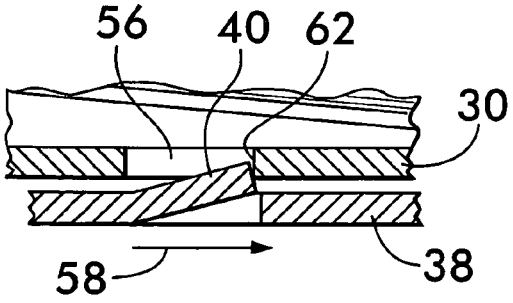
FIG.6A
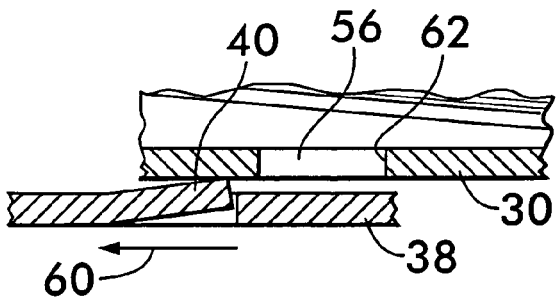
FIG.6B

NON-DEFEATABLE FLUORESCENT ADAPTER FOR INCANDESCENT FIXTURE

FIELD OF THE INVENTION

The invention pertains to adapters for allowing fluorescent lamps to be used with light fixtures designed for incandescent bulbs, and in particular to an adapter that is not removable by a consumer after it has been installed in an incandescent fixture.

BACKGROUND OF THE INVENTION

Incandescent lamps have been in use for over a hundred years, and remain in widespread use. They are relatively inexpensive to purchase and easy to replace. Fluorescent lamps use less energy than incandescent lamps. They are, however, initially more expensive to purchase than incandescent bulbs and more expensive to replace, and may not be as readily available as incandescent bulbs, which can be found at many retail locations.

Although fluorescent lamps are more energy-efficient, many light fixtures are designed only for standard incandescent light bulbs. To use a fluorescent lamp in such fixtures requires an adapter. Adapters for allowing fluorescent lamps to be used in place of incandescent lamps in such fixtures are known. Typically, such adapters include a housing that contains or can receive a fluorescent ballast, a socket for receiving the contact pins of a fluorescent lamp, and a threaded ring contact and a tip contact similar or identical to those on the base of a standard incandescent bulb, which allows the adapter to be simply screwed into a standard incandescent socket.

Typically, known fluorescent adapters can be removed from a standard incandescent socket just as easily as they can be installed. That is not normally a problem, but in some cases it is desirable to prevent the adapter from being removed after installation. For example, some manufacturers of fluorescent lamps are partners in ENERGY STAR®, a program sponsored by the U.S. Environmental Protection Agency to promote energy efficiency. Many manufacturers of electrical appliances are ENERGY STAR® partners, and many of the ENERGY STAR® partners offer rebates on qualified products. In those cases, it would defeat the purpose of the ENERGY STAR® program, and subject manufacturers to payment of unnecessary rebates, if the fluorescent adapter could be removed and the consumer could revert to incandescent bulbs.

There is a need for a fluorescent adapter that can be installed as easily as an incandescent light bulb but that cannot be removed after installation. The present invention meets that need.

SUMMARY OF THE INVENTION

In one of its embodiments, the present invention encompasses a fluorescent adapter, comprising a housing including a tip contact compatible with an electrical socket, a threaded ring contact compatible with the electrical socket, the ring contact surrounding the housing and rotatable with the housing when the housing is rotated in a first direction and not rotatable with the housing when the housing is rotated in an opposite direction, and a fluorescent ballast supported by the housing and having input electrodes in electrical contact with the tip contact and the ring contact, respectively, and output electrodes for removably receiving the contact pins of a fluorescent lamp.

In another embodiment, the invention encompasses a compact fluorescent lamp assembly, comprising a fluorescent lamp having contact pins, a housing including a tip contact compatible with an electrical socket, a threaded ring contact compatible with the electrical socket, the ring contact surrounding the housing and rotatable with the housing when the housing is rotated in a first direction and not rotatable with the housing when the housing is rotated in an opposite direction, a fluorescent ballast supported by the housing and having input electrodes in electrical contact with the tip contact and the ring contact, respectively, and output electrodes for removably receiving the contact pins of the fluorescent lamp, and an enclosure removably attached to the ballast for enclosing at least the fluorescent lamp.

In still another embodiment, the invention encompasses a fluorescent adapter, comprising a housing including a tip contact compatible with an electrical socket, a threaded ring contact compatible with the electrical socket, the ring contact surrounding the housing and rotatable with the housing when the housing is rotated in a first direction and not rotatable with the housing when the housing is rotated in an opposite direction, a fluorescent ballast supported by the housing and having input electrodes in electrical contact with the tip contact and the ring contact, respectively, and output electrodes for removably receiving the contact pins of a fluorescent lamp, and a drive member on the housing for engaging the ring contact when the housing is rotated in the first direction during insertion of the adapter into the electrical socket and for disengaging from the ring contact when the housing is rotated in the opposite direction, wherein the drive member comprises a disc having at least one tooth and the ring contact includes at least one arcuate slot for receiving the tooth when the housing is rotated in the first direction.

In a further embodiment, the invention encompasses a fluorescent adapter, comprising a housing including a tip contact compatible with an electrical socket, a threaded ring contact compatible with the electrical socket, the ring contact encircling the housing and freely rotatable relative to the housing when the housing is rotated in a first direction, and means for preventing relative rotation between the ring contact and the housing when the housing is rotated in a second direction opposite the first direction to insert the adapter into the socket.

In another aspect of the invention, the invention encompasses a method of non-removably inserting a fluorescent adapter into an electrical socket comprising the steps of providing a threaded ring contact surrounding and freely rotatable on an adapter housing, preventing relative rotation between the ring contact and the housing when the housing is rotated in a first direction to insert the adapter into the socket, and permitting free relative rotation between the ring contact and the housing when the housing is rotated in a second direction opposite the first direction.

BRIEF DESCRIPTION OF THE DRAWINGS

For illustrating the invention, there is shown in the drawings a form that is presently preferred; it being understood, however, that this invention is not limited to the precise arrangements and instrumentalities shown.

FIG. 4 is a cross-sectional view of the adapter according to the present invention, taken along the lines 4—4 in FIG. 1.

FIG. 4A is a partial top plan view, taken along the lines 4A—4A in FIG. 4.

FIG. 5 is a section view of the adapter, taken along the lines 5—5 in FIG. 4.

FIG. 6A and FIG. 6B are partial section views, taken along the lines 6A,B—6A,B in FIG. 5.

DESCRIPTION OF THE PREFERRED EMBODIMENT

Figure 1:
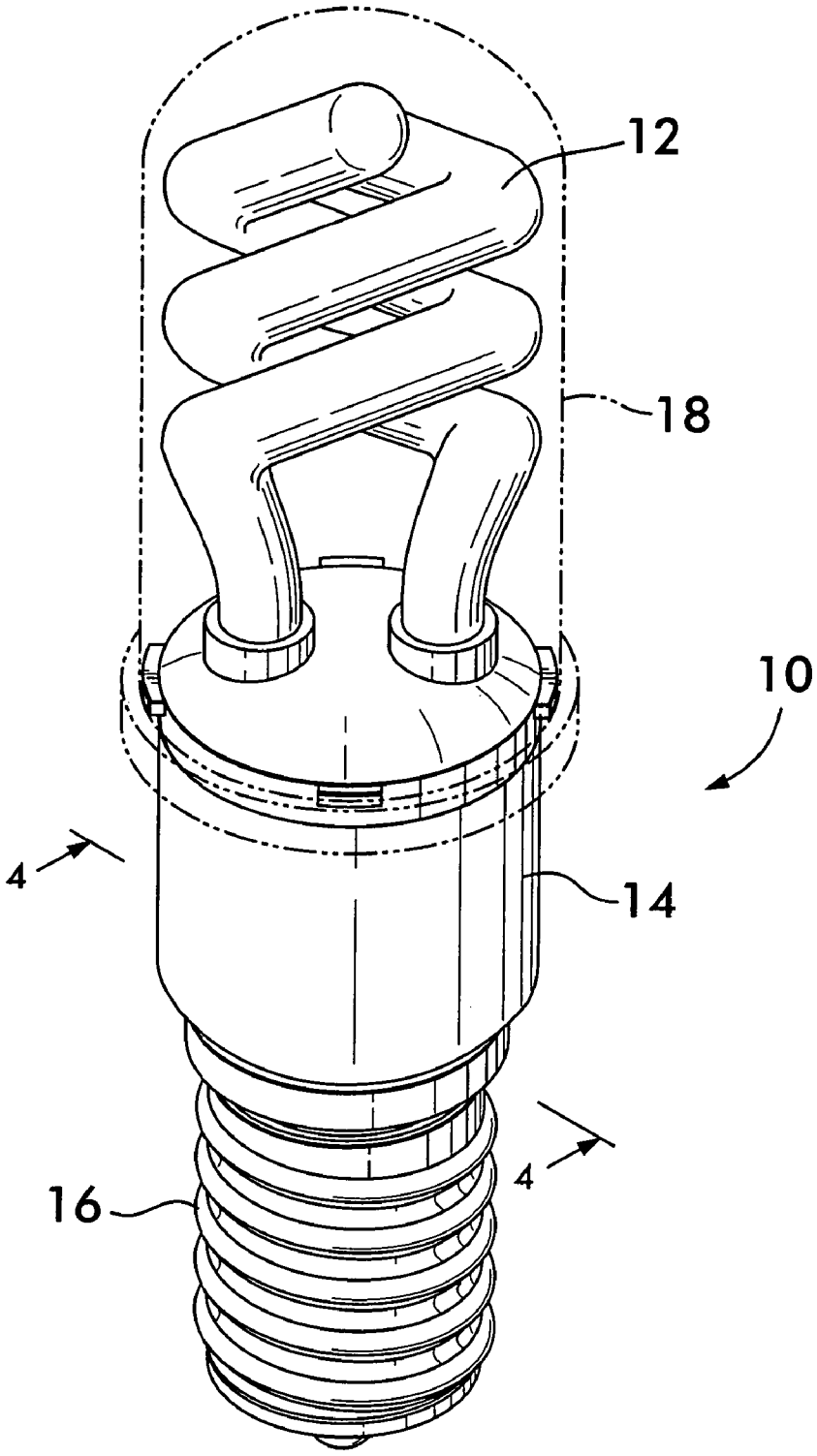
FIG. 1 is a perspective view of an adapter according to the invention, in combination with a fluorescent ballast and a fluorescent lamp with an optional cover shown in phantom.

Referring to the drawings, in which like numerals indicate like elements, there is shown in FIG. 1 a compact fluorescent lamp assembly 10 comprising a fluorescent lamp 12, a ballast 14, and an adapter 16 according to the present invention. Fluorescent lamp 12 may be a fluorescent lamp in any of numerous configurations, including conventional helical, spiral, and U-shaped fluorescent lamps. An optional enclosure 18, for enclosing at least the fluorescent lamp 12, is also shown. Enclosure 18 may be clear or frosted, as desired.

Figure 2:
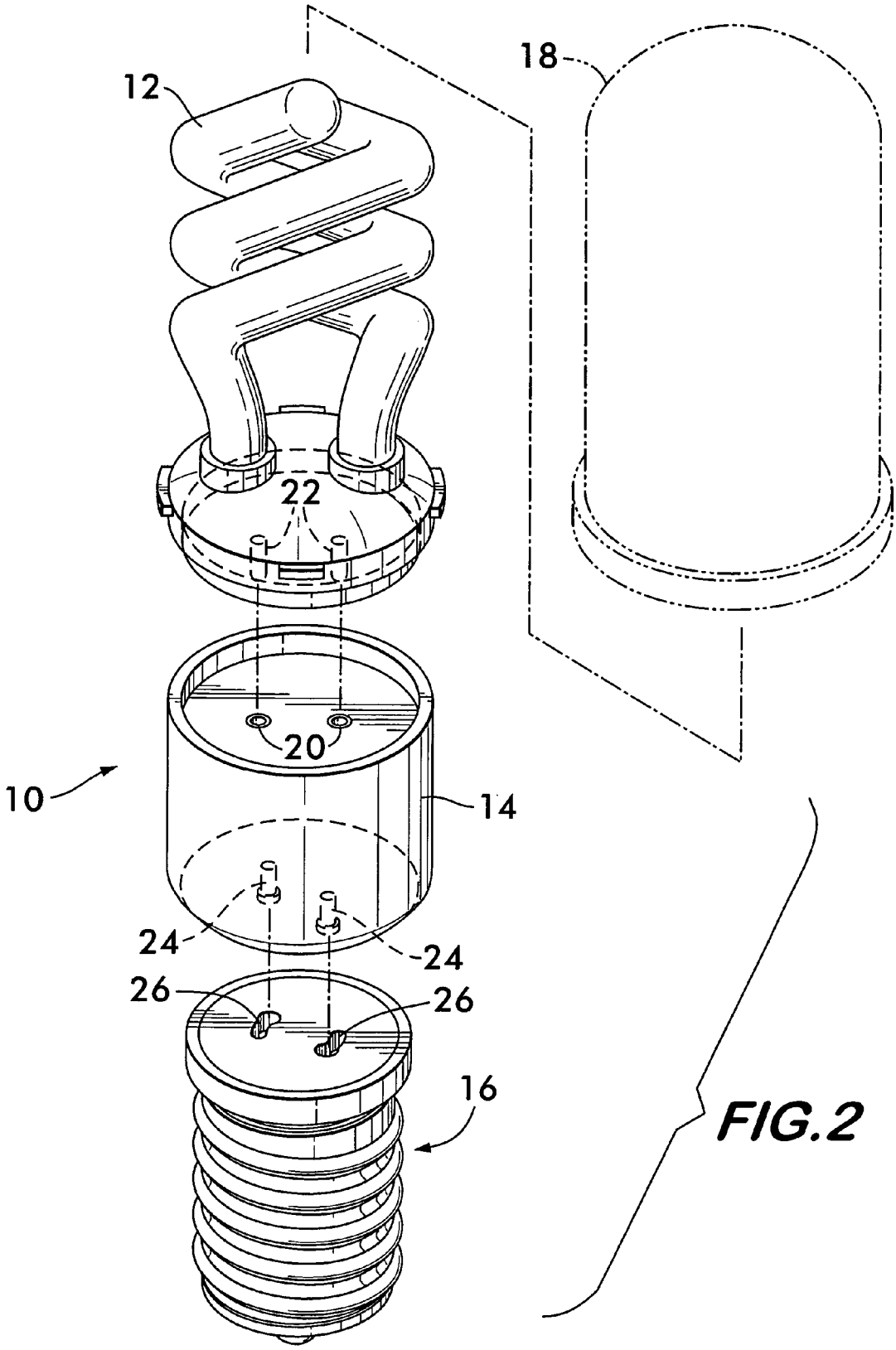
FIG. 2 is an exploded view of the combination of FIG. 1.

As best seen in FIG. 2, fluorescent lamp 12 may be inserted in conventional fashion into ballast 14, which includes two receptacles 20 for receiving contact pins 22 of fluorescent lamp 12. In another embodiment, lamp 12 includes four contact pins 22, and ballast 14 includes four matching receptacles 20. Ballast 14, receptacle 20, and contact pins 22 may be conventional. Ballast 14 also includes a pair of contact pins 24 and receptacles 26 to connect ballast 14 to adapter 16. The contact pins 22, 24 and receptacles 20, 26 serve to provide an electrical path from adapter 16 to lamp 12. The number of contact pins 22, 24 and receptacles 20, 26 may be varied without departing from the scope of the invention.

Figure 3:
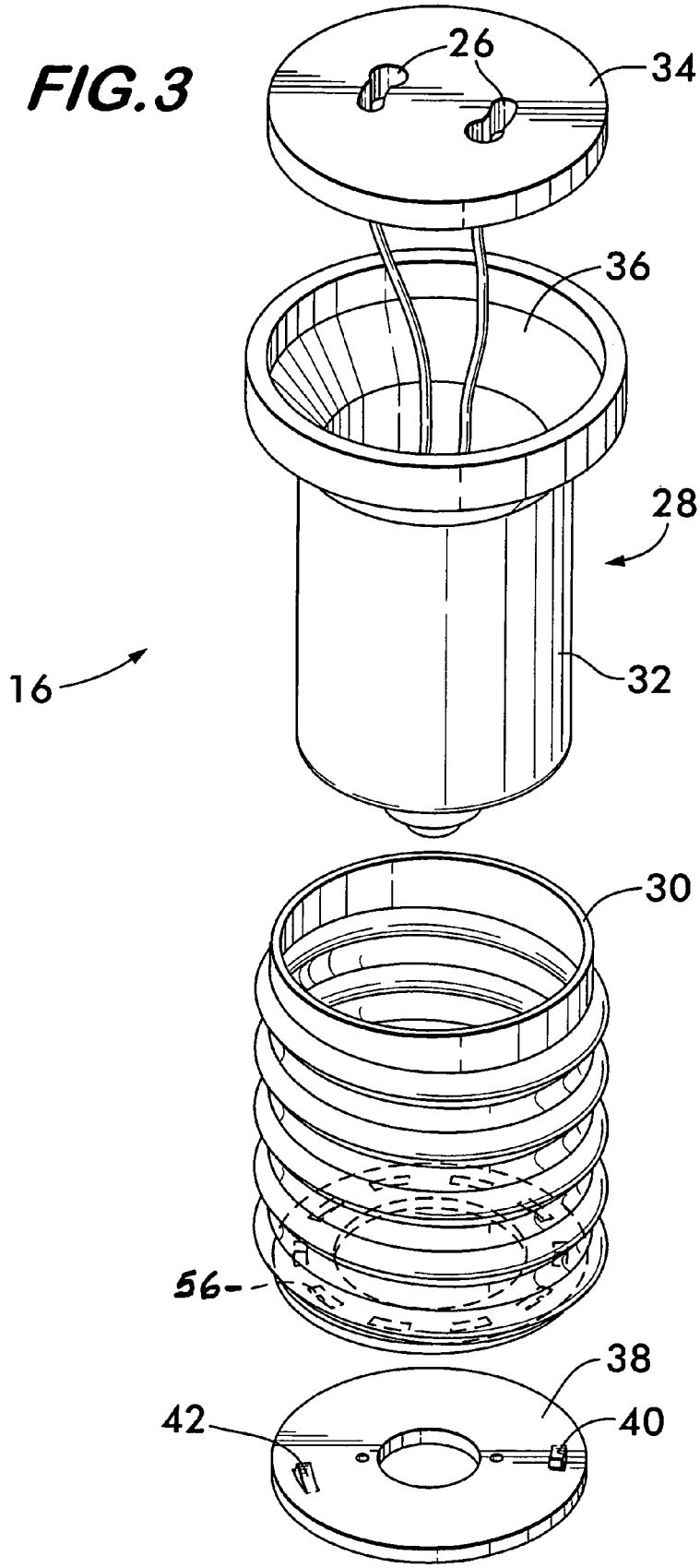
FIG. 3 is an exploded view of the adapter.

Adapter 16 is shown in more detail in FIG. 3. Adapter 16 comprises a housing 28, which is preferably made of plastic or other non-conducting material. Housing 28 is surrounded by a conductive ring contact 30, which is free to rotate circumferentially around the barrel portion 32 of housing 28. Housing 28 has a top plate 34 which supports receptacles 26. Top plate 34 is inserted into the top opening 36 of housing 28 and may be held in place by friction fit, adhesive, or the like.

At the bottom of housing 28 is a drive member 38 in the form of a toothed disc. Drive member 38 has two projecting teeth 40, 42, which project upwardly from its top surface and engage slots 56 in ring contact 30, as will be explained more fully below.

FIG. 4 shows the elements of adapter 16 in cross section. Ring contact 30 is threaded on its outer surface 46 in the same manner as a conventional incandescent bulb. Similarly, at the bottom end of housing 28 is a tip contact 48, also as found on a conventional incandescent bulb. Wires 50 and 52 provide an electrical path from ring contact 30 and tip contact 48, receptively, to receptacles 26 in top plate 34, which receive contact pins 24 of ballast 14.

As seen in FIG. 4A, the contact pin 24 and the receptacles 26 may be arranged in a keyhole slot configuration so that a slight twist releasably locks the ballast in place on housing 28, and so that a slight twist in the opposite direction allows ballast 14 to be removed. The ballast input electrodes 24 include a shaft portion and a head portion, as shown in FIG. 4A. When the ballast 14 is locked to the adapter 16, the head portions engaae the receptacles 26 to prevent the ballast 14 from being separated (along a longitudinal direction) from the adapter 16. It will be appreciated that one advantage of this locking "bayonet" style connection between the pins 24 and receptacles 26 is that it allows greater weight to be supported by the ballast 14 with the lamp assembly 10 in an inverted position (that is, with the lamp 12 and ballast 14 positioned below the adapter 16). For example, if a lamp shade (not illustrated) or other component were connected to the ballast 14, the bayonet style connection would allow the ballast 14 to support the weight of the lamp shade while in an inverted position, while remaining firmly connected to the adapter 16. In contrast, a conventional straight contact pin received in a conventional straight receptacle would be less capable of supporting substantial weight in an inverted position.

Drive member 38 may be fixedly attached to housing 28, such as by eyelets 54, adhesive, and the like. In this manner, while housing 28 is free to rotate inside ring contact 30, drive member 38 will rotate with housing 28. Optionally, drive member 38 may be integrally molded into housing 28.

As best seen in FIG. 5, the bottom of ring contact 30 is provided with a plurality of arcuate slots 56, which are arranged circumferentially around the bottom. Slots 56 may be holes through ring contact 30, or may be notches or depressions in ring contact 30. Slots 56 engage teeth 40, 42 in drive member 38.

Referring together to FIGS. 5, 6A and 6B, adapter 16 may be turned either clockwise, as represented by arrow 58, or counter-clockwise, as represented by arrow 60. When adapter 16 is rotated in the clockwise direction, housing 28 rotates freely within ring contact 30 until the edge of tooth 40 contacts the wall 62 of slot 56. Continued movement of housing 28 in the clockwise direction will thereafter cause ring contact 30 to rotate with housing 28. Thus, adapter 16 can be screwed into a conventional incandescent socket in the same manner as a conventional incandescent bulb.

However, when housing 28 is rotated in the counter-clockwise direction, in an attempt to remove adapter 16 from the socket, tooth 40 will not engage any of the slots 56, but will move freely past slots 56. Thus, once adapter 16 has been threaded into a socket, it cannot be removed. Instead, rotation of housing 28 in a counter-clockwise direction, as though to remove it, will simply result in movement of housing 28 within ring contact 30 while adapter 16 remains in place.

Drive member 38 may be punched or stamped to create projecting teeth 40, 42, or the teeth 40, 42 may be integrally molded into drive member 38. In one embodiment, drive member 38 and ring contact 30 may be conventional parts available from Well Sun Co., Ltd., of Taipei, Taiwan.

Optionally, additional pairs of projecting teeth 40, 42 may be circularly arranged on drive member 38 to engage additional slots 56 in ring contact 30, providing increased stability and protection against breakage of one or more teeth.

In an alternative embodiment, the projecting teeth 40, 42 may be disposed on ring contact 30 to engage slots 56 circularly arranged on drive member 38.

It should be understood that other techniques for permitting the ring contact to be threaded into a socket into one direction but not in the opposite direction can be used without departing from the scope of the invention. Thus, for example, instead of a drive member having projecting teeth and slots in the bottom of the ring contact, an eccentric drive technique could be used, whereby the barrel portion 32 and ring contact 30 engage each other only when the housing 28 is rotated in the clockwise direction, but do not engage each other when the housing is rotated in the counter-clockwise direction. Numerous other one-way drive and ratchet-type drive techniques can be used without departing from the invention.

The present invention may be embodied in other specific forms without departing from the spirit or essential attributes thereof and, accordingly, reference should be made to the appended claims, rather than to the foregoing specification, as indicating the scope of the invention.

What is claimed is:

1. A fluorescent adapter, comprising a housing including a tip contact compatible with an electrical socket, a threaded ring contact compatible with the electrical socket, the ring contact surrounding the housing, secured to the housing and rotatable with the housing when the housing is rotated in a first direction and not rotatable with the housing when the housing is rotated in an opposite direction, a fluorescent ballast supported by the housing and having input electrodes in electrical contact with the tip contact and the ring contact, respectively, and output electrodes for removably receiving the contact pins of a fluorescent lamp, and a drive member on the housing for engaging the ring contact when the housing is rotated in the first direction during insertion of the adapter into the electrical socket and for disengaging from the ring contact when the housing is rotated in the opposite direction, the drive member being integrally molded into the housing and including at least one tooth for engaging the ring contact when the housing is rotated in the first direction.

2. The adapter of claim 1, wherein the ring contact includes at least one opening for receiving the tooth when the housing is rotated in the first direction.

3. The adapter of claim 1, wherein the drive member comprises a disc having at least one tooth and the ring contact includes at least one opening for receiving the tooth when the housing is rotated in the first direction.

4. The adapter of claim 3, wherein the at least one opening is an arcuate slot.

5. A method of non-removably inserting a fluorescent adapter into an electrical socket comprising the steps of providing a threaded ring contact surrounding and freely rotatable on an adapter housing, preventing relative rotation between the ring contact and the housing when the housing is rotated in a first direction to insert the adapter into the socket by engaging a slot in the ring contact with a projection on the housing and thereafter rotating the ring contact in the first direction together with the housing, and permitting free relative rotation between the ring contact and the housing and preventing axial separation of the ring contact and the housing when the housing is rotated in a second direction opposite the first direction.

6. A compact fluorescent lamp assembly, comprising a fluorescent lamp having contact pins, an adapter including a tip contact compatible with an electrical socket;

a threaded ring contact compatible with the electrical socket, and keyhole slot receptacles, and a fluorescent ballast having input electrodes in electrical contact with the tip contact and the ring contact, respectively, and output electrodes for removably receiving the contact pins of the fluorescent lamp, wherein the keyhole slot receptacles are adapted to receive the ballast input electrodes in a bayonet style connection.

7. A fluorescent adapter, comprising:

a housing including a receptacle adapted to receive input electrodes of a fluorescent ballast and a tip contact compatible with an electrical socket and in electrical communication with the receptacle for connection with a said input electrode of the fluorescent ballast; and a threaded ring contact compatible with the electrical socket, captive to the housing and rotatable with the housing when the housing is rotated in a first direction and not rotatable with the housing when the housing is rotated in an opposite direction, and in electrical communication with the receptacle for connection with another said input electrode of the fluorescent ballast.

8. A fluorescent adapter according to claim 7, wherein the receptacle comprises keyhole slots adapted to receive the ballast input electrodes in a bayonet style connection.

9. A fluorescent adapter according to claim 8, further comprising a ballast with input electrodes having head portions adapted to engage the keyhole slots of the receptacle of the adapter housing and a receptacle for a fluorescent lamp.

10. A fluorescent adapter according to claim 7, further comprising a ballast with input electrodes adapted to engage the receptacle of the adapter housing and a receptacle for a fluorescent lamp.

11. A fluorescent adapter according to claim 10, further comprising a fluorescent lamp adapted to engage the receptacle of the ballast.

* * * * *